US005853245A

United States Patent [19]

Price

[11] Patent Number: 5,853,245

[45] Date of Patent: Dec. 29, 1998

[54] ROCK BIT CUTTER RETAINER WITH DIFFERENTIALLY PITCHED THREADS

[75] Inventor: Randall R. Price, Houston, Tex.

[73] Assignee: Camco International Inc., Houston, Tex.

[21] Appl. No.: 942,128

[22] Filed: Oct. 1, 1997

Related U.S. Application Data

[60] Provisional application No. 60/028,964 Oct. 18, 1996.

[51] Int. Cl.[6] ..... E21B 10/22

[52] U.S. Cl. ..... 384/96; 384/95; 175/371

[58] Field of Search ..... 384/92, 95, 96; 175/371; 76/108.2; 411/937.1

[56] References Cited

U.S. PATENT DOCUMENTS

| | | | |
|---|---|---|---|
| 3,971,085 | 7/1976 | Mount | 411/937.1 X |
| 3,971,600 | 7/1976 | Murdoch | 384/93 |
| 3,989,315 | 11/1976 | Murdoch | 384/96 |
| 4,236,764 | 12/1980 | Galle | 384/96 |
| 4,865,137 | 9/1989 | Bailey et al. | 384/95 X |
| 4,911,255 | 3/1990 | Pearce | 384/96 X |
| 4,991,671 | 2/1991 | Pearce et al. | 384/96 X |
| 5,012,701 | 5/1991 | Daly | 76/108.2 |
| 5,024,539 | 6/1991 | Vezirian | 384/96 X |

*Primary Examiner*—Thomas R. Hannon

[57] ABSTRACT

A novel split threaded ring bearing member for rolling cutter drill bits with at least a portion of its threads having a different pitch than its mating threads is disclosed. The pitch difference is designed so that the threaded ring can be seated or otherwise located precisely with respect to the other bearing elements within the drill bit to effectively control the axial displacement of the rolling cutter on the bearing spindle within a given tolerance range. Upon assembly, the difference in thread pitch causes the opposite, opposing mating thread flanks to engage, effectively applying a tensile or compressive force to a portion of the threaded ring bearing member, which gradually increases as the assembly is tightened. The result is an improved rolling cutter drill bit with a threaded ring cutter bearing system with excellent resistance to back-off which will not allow significant radial movement between the engaged threads, even if some back-off of the threads occurs.

14 Claims, 4 Drawing Sheets

ROCK BIT CUTTER RETAINER WITH DIFFERENTIALLY PITCHED THREADS

BACKGROUND OF THE INVENTION

This application claims benefit of USC Provisional Appln. No. 60/026,964, filed Oct. 18, 1996.

1. Field of the Invention

This invention relates to an improved mechanism for assembling cutters on supporting bearing spindles in roller cutter earth boring bits. The invention causes the retention bearing mechanism to remain centered within the bearing system of a cutter in an earth boring bit cutter during operation, thereby providing greater reliability and reduced wellbore drilling costs.

2. Description of the Related Art

Cutter retention systems for rolling cutter drill bits are well known in the art. For example, ball bearings can be inserted through a hole in the body to fill a groove between the rolling cutter and the bit body as shown in U.S. Pat. No. 3,989,315. Alternatively, a snap ring can be positioned in the same general area as the ball bearings as shown in U.S. Pat. No. 4,236,764. Finally, a split threaded thrust bearing member can be installed in the bit as shown in U.S. Pat. Nos. 3,971,600. Other threaded ring rolling cutter retention mechanisms are shown in U.S. Pat. Nos. 4,911,255; 4,991,671; 5,012,701; 5,024,539 and 5,383,525.

The threaded ring bearing retention mechanism has been found to provide superior cutter retention performance as compared to the other retention systems as long as the threaded ring remains securely seated within the rolling cutter. If the threaded ring becomes loosened from its intended position, the resulting excessive axial cutter displacement is detrimental to the cutter seal, resulting in premature bearing failure and shorter than expected bit life. As described in U.S. Pat. No. 5,383,525, the threaded ring is designed to resist unseating after the bit is assembled by provision of mechanical alterations to the intermeshing threads so that even with the occasional reverse rotation of the rolling cutter the threaded ring will not loosen. In spite of this improvement, there is evidence that bits runs under extremely adverse conditions would have performed even better at times, were it not for degradation of the threaded ring bearing retention mechanism.

In exploring the reasons for this degradation, the first problem found was that the beneficial effect of deforming the threads at assembly could be significantly reduced by relative radial movement between the engaged threads of the ring and the cutter during operation. This movement is possible because the normal tolerances in threads allow significant clearances between the crests, flanks, and roots of mating threads. In common screw thread fastening systems, this clearance is not at issue because the assembly torque causes enough elastic energy to be stored in the fastener to cause the mating thread flanks to remain engaged. This is possible because the diameter of the threaded fastener is generally much less than its length, allowing high linear strain in the fastener with relatively low assembly torque.

In drill bits with threaded ring bearing retention systems, however, the fastener's diameter is generally several times greater than its length. The rolling cutter is normally made with alloy steels hardened to about 40 Rockwell 'C' with yield strengths greater than 150,000 PSI. The design geometry of the cutters maximizes stiffness in the bearing area and minimizes plastic and elastic deformations. For these reasons, there is no known practical method to apply enough torque to this type of threaded assembly to insure enough elastic strain to effectively maintain flank contact of the engaged threads in operation. Therefore, in order to assure the rings do not loosen in operation, a portion of the threads are deformed with a special tool during assembly to eliminate back off. In extremely dynamic drilling conditions, however, the impact forces and vibrations can become so high that a small amount of back off can occur.

Once any type of threaded fastener loosens, even slightly, it can wobble about. In rolling cutter drill bits using threaded bearing rings, this wobbling about can effectively nullify any deformation of threads performed to secure the assembly by nibbling away the deformed material or by bending it back to its original position.

A second problem associated with the loosening of the threaded ring is due to the split nature of the rings. Because each ring half can move independently, even slight backing off of the threaded ring allows each half to slide radially until the roots and crests of the mating threads engage. This can cause the effective inside diameter of the paired ring halves to change by 0.030 inches or more and can drastically reduce the threaded ring's retention force or cause an unacceptable gap in a radial bearing member.

Similar problems can occur in rock bit bearing systems designed primarily to carry the radial loads imposed by the cutter on the bearing spindle. This type of bearing often doubles as both a thrust retention bearing and a radial load carrying bearing. Two such bearing designs are shown in U.S. Pat. Nos. 4,865,137 and 5,024,539.

In extreme drilling conditions, impact and vibration forces present during drilling can cause slight loosening of prior art threaded rings. This is most evident when drilling wellbores with high angular deviations. In these circumstances it has been found that the normal thread clearances in these threaded rings provide space for the relative radial sliding or wobbling between the engaged threads. This radial movement can remove the mechanical deformation used to prevent loosening of the threads. The radial movement also enlarges the effective diameter of the retention member, causing loss of engaging interference between the threaded ring and the flange on the bearing spindle. Both of these problems can limit the performance of a rolling cutter drill bit.

For these reasons, there is a need for a drill bit with a threaded ring cutter bearing system which will not allow significant radial movement between the engaged threads even if some back-off of the threads occurs.

SUMMARY OF THE INVENTION

The present invention is a threaded ring bearing member for rolling cutter drill bits with at least a portion of its threads having a different pitch than its mating threads. In this specification, thread pitch is defined as the number of threads per unit of length. The pitch difference is designed so that the threaded ring can be seated or otherwise located precisely with respect to the other bearing elements within the drill bit to effectively control the axial displacement of the rolling cutter on the bearing spindle within a given tolerance range. Upon assembly, the difference in thread pitch causes the opposite, opposing mating flanks to engage, effectively applying a tensile or compressive force to a portion of the threaded ring bearing member, which gradually increases as the assembly is tightened.

The action of the ramp angles on the opposing thread flanks between the threaded ring and its mating threads in the cutter bore force the two ring halves together in the center of the bore as the assembly is tightened. This eliminates any possible radial movement between the engaged threads. Because elastic deformations are involved, no radial movement will occur with a small amount of loosening of the assembly. This action effectively prevents two modes of threaded ring degradation found in drill bits run in extreme drilling environments.

According to one aspect of the invention there is provided a rolling cutter drill bit of the kind having a bit body, a bearing spindle on the bit body, and a rolling cutter rotatably mounted on the bearing spindle. There is a first set of screw threads formed on either the cutter or the spindle, a portion of this first set of screw threads having a first thread pitch. There is a split threaded ring bearing mounted between the cutter and spindle having a second set of screw threads, a portion of this second set of screw threads having a second thread pitch. The split threaded ring is in screw threaded engagement with one of the cutter or spindle, and the first thread pitch is different from the second thread pitch.

A portion of one of the screw-threads may be mechanically deformed by an implement after assembly to further improve resistance to back off of the threaded retention member.

DETAILED DESCRIPTION OF THE PREFERRED EMBODIMENTS

Figure 2:
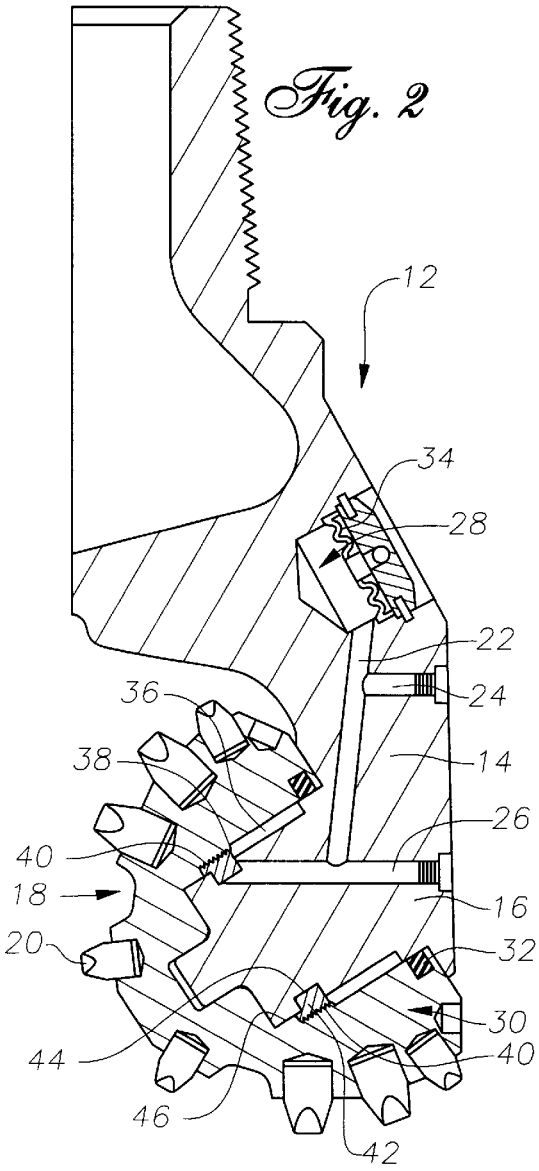
FIG. 2 is a cross sectional view of one preferred embodiment of an earth boring bit of the present invention showing the general arrangement of the cutter's lubrication and bearing system.
Figure 1:
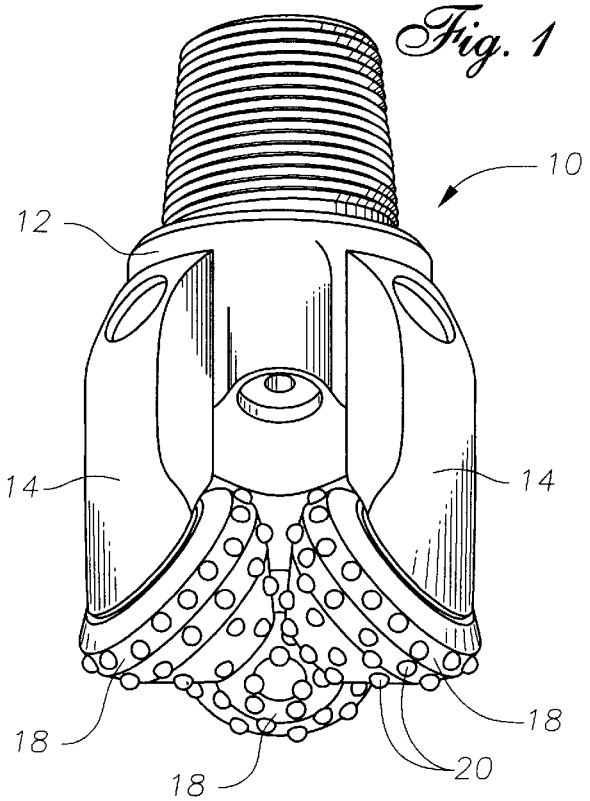
FIG. 1 is a perspective view of a rolling cutter drill bit of the present invention.

Referring now to the drawings in more detail, and particularly to FIGS. 1 and 2, a rolling cutter earth boring bit 10 includes a body 12 with three similar leg portions 14. A cantilevered bearing spindle 16 formed on each leg 14 extends inwardly and downwardly. A rolling cutter 18 is rotatably mounted upon each leg 14. Attached to the rolling cutter 18 are cutting inserts 20 which engage the earth to effect a drilling action and cause rotation of the rolling cutter 18. Typically, each cutting insert 20 will be formed of hard, wear resistant material. Internal passageways 22, 24 & 26, as well as a reservoir 28 and bearing area 30 of the leg 14, are filled with lubricant (not shown) during bit assembly. The lubricant helps reduce friction during bit operation and is retained within the cutter 18 by a dynamic seal 32. A pressure balancing diaphragm 34 serves to equalize internal and external pressures.

One passageway 26 provides an access used in assembly of the bit. The cutter 18 is mounted upon the cantilevered bearing spindle 16 formed on the leg 14. A floating friction bearing member 36 is located between the spindle 16 and a mating bearing cavity 38 formed in the cutter 18.

An internal thread 40 is formed on the surface of an internal cavity of the cutter adjacent the bearing area 30, and a split externally threaded retaining ring 42 is positioned in a peripheral groove 44 on the spindle 16 and is threadedly engaged with the threads 40 on the cutter 18. This threaded ring 42 is mounted coaxially with the cutter 18 and spindle 16, and retains the cutter 18 upon the spindle 16 by forming an interference with a flange 46 on the bearing spindle 16.

The dimensional characteristics of the threaded ring 42, the groove 44 in the spindle 16, and the cavity 38 in the cutter are such as to allow some axial displacement of the cutter 18 with respect to the spindle 16.

Figure 2A:
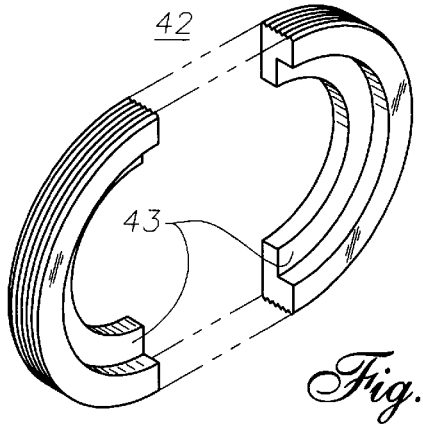
FIG. 2A is a perspective view of a threaded ring bearing of one embodiment of the present invention.

In one embodiment of the present invention shown in FIG. 2A, the threaded ring bearing 42 is formed of two similar halves 43, and is configured with a threaded surface on its outside diameter when the two halves are joined at assembly.

Figure 3:
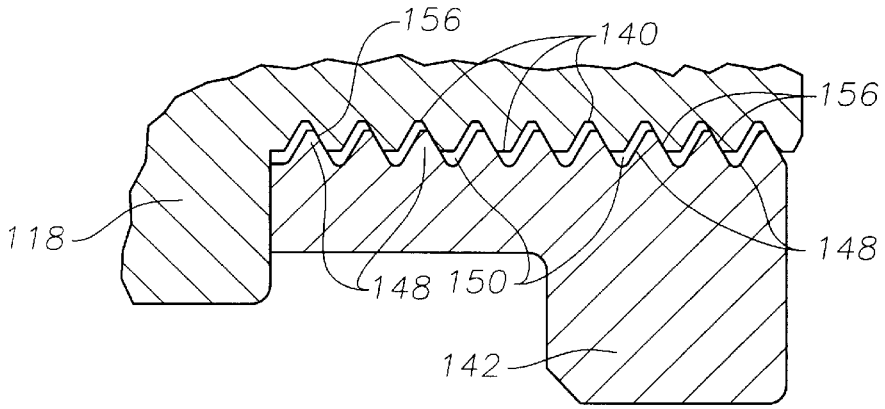
Fig. 3 (PRIOR ART)
FIG. 3 is an enlarged cross sectional view of the threads of the prior art threaded ring engaged in the threads of the rolling cutter.
Figure 4:
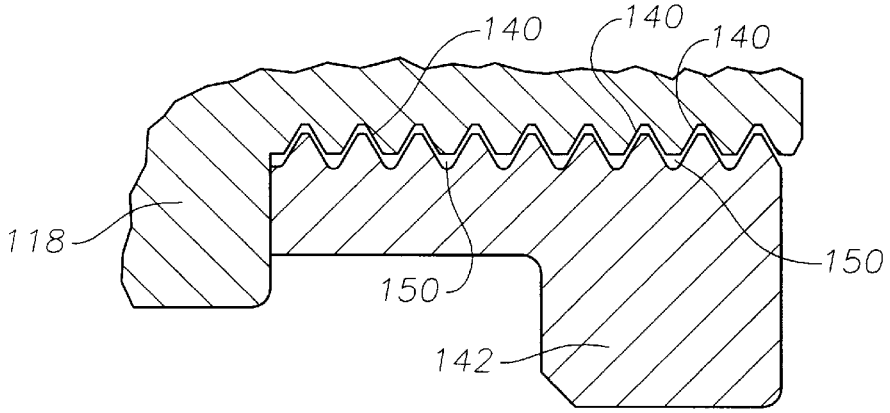
Fig. 4 (PRIOR ART)
FIG. 4 is an enlarged cross sectional view of the threads of the prior art threaded ring engaged in the threads of the rolling cutter with the ring slightly loosened.
Figure 5:
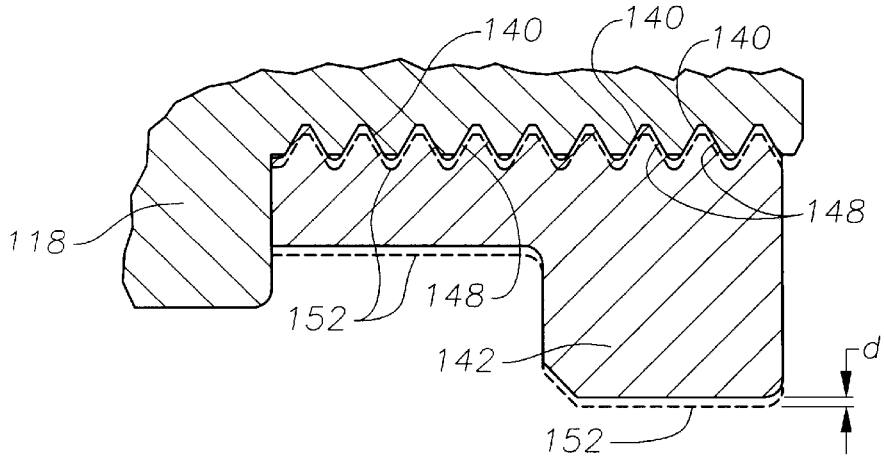
Fig. 5 (PRIOR ART)
FIG. 5 is an enlarged cross sectional view of the threads of the prior art threaded ring engaged in the threads of the rolling cutter with the ring slightly loosened showing a radial displacement caused by the further meshing of the loosened threads.

Referring now to the prior art threaded rings shown in FIGS. 3, 4, and 5, a threaded ring bearing 142 is shown in various forms of engagement with the cutter 118. In FIG. 3 the ring 142 is shown made up tight with the cutter 118. The threads 148 on the threaded ring 142 engage the threads 140 in the cutter 118 along the flanks 156 leaving relative large gaps 150 between the sets of threads due to normal machine thread practice.

In FIG. 4 the prior art threaded ring 142 has very slightly unscrewed to open the gap 150 completely around each thread. This gap can occur in typical screwed fasteners with rotations of less than 10 degrees, and in the thread forms used in drill bits this rotation can be less than 5 degrees.

In FIG. 5 the threaded ring 142 has been pushed radially toward the threads 140 in the cutter 118 to substantially close the gap 150 shown in FIG. 4. The dotted lines 152 show the position of the ring before the gap 150 is closed. When gap 150 is closed, the inner portion of the ring moves by a distance d radially away from the center of the bearing spindle. Because this portion of the threaded ring 142 engages the flange on the bearing spindle in an interfering manner to retain the cutter 118 on the bearing spindle, the retention interference available is reduced by the radial distance d. Since these threaded bearings 142 are split rings, each ring half can move independently. Therefore, the diametrical interference between the threaded ring 142 and the flange can be reduced by two times d.

Figure 6:
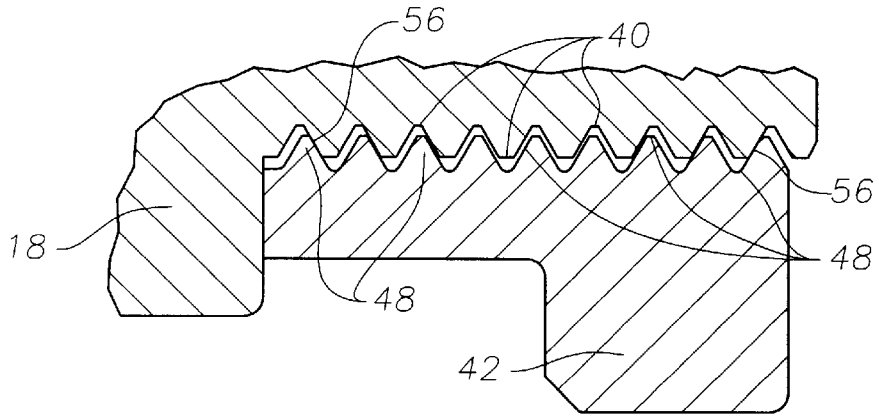
FIG. 6 is an enlarged cross sectional view of the threads of the present invention.

The preferred embodiments of the present invention are shown in FIGS. 6, 7, 8, and 9. In FIG. 6 the threads 48 of the threaded ring bearing 42 are formed with a slightly different pitch than the threads 40 in the cutter 18. In this specification, thread pitch is defined as the number of threads per unit of length. In the example shown, the thread pitch of the threaded ring bearing 42 is slightly greater than the thread pitch of the cutter threads 40. The difference in pitch depends upon the engaged length of the threads, the thread form, and the amount of assembly torque desired. In most rolling cutter drill bits the difference in the thread pitch of the threaded bearing member 42 is between 0.05% and 5% of the thread pitch of the cutter threads 40. For 4¾ inch diameter drill bits, the range of effective thread pitch differences has been found to be from about 0.5 to 1.2 threads per inch. In other bit sizes, due to the differences in the engaged length of threads, effective thread pitch differences have been found to range from about 0.1 to about 2 threads per inch. Note however, that because there are a great number of different thread forms, engaged lengths and assembly torque's possible in threaded bearing members for drill bits, there is no set pitch differential that can be deemed as best.

The configuration of the threaded bearing 42 of FIG. 6 is such that the engaged flanks 56 at opposite ends of the ring provide interference in the threads as the assembly is subjected to assembly torque. The interference force acts on the flanks 56 in a manner that tends to push the threaded ring bearing 42 away from the cutter 18. This force, therefore pushes each half of the split pair of threaded rings together. Given sufficient assembly interference, even 10 or more degrees of back-off of this assembly will not allow these threaded ring bearings 42 to move radially by any appreciable amount.

Figure 7:
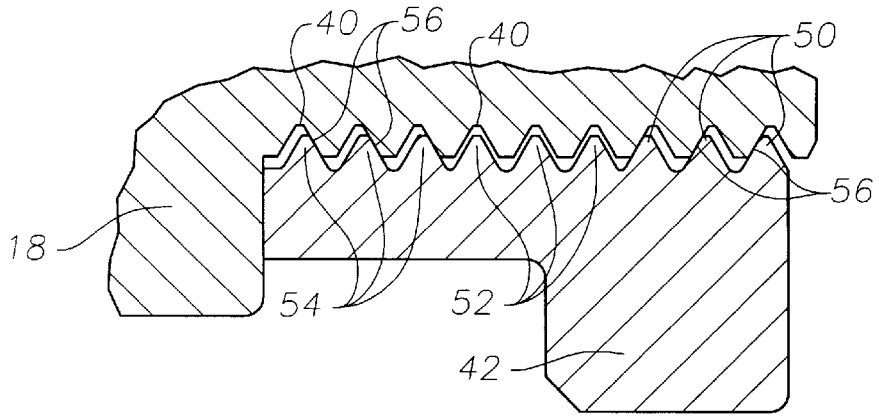
FIG. 7 is an enlarged cross sectional view of the threads of an alternate embodiment of the present invention.

Another embodiment of the present invention is shown in FIG. 7. In this embodiment, the threaded ring bearing 42 has thread sets 50, 52 and 54 spaced such that there are effectively three different thread pitches. Although formed somewhat differently than the ring of FIG. 6, the operating principle is the same. The flanks 56 at the opposite ends of the engaged threads act to provide interference in the same manner described above.

Figure 8:
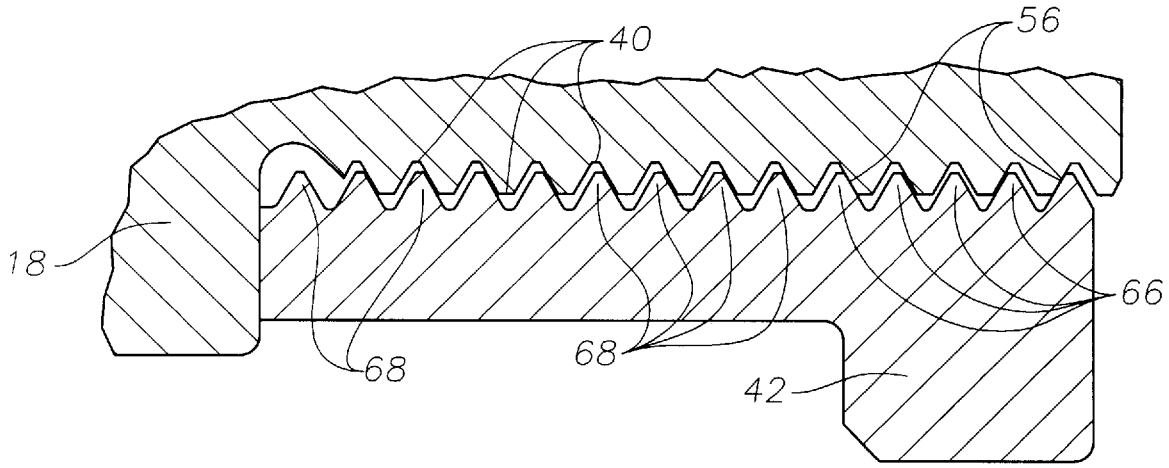
FIG. 8 is an enlarged cross sectional view of the threads of another embodiment of the present invention.

Still another embodiment of the present invention is shown in FIG. 8. In this embodiment, the threaded ring bearing 42 has a small set of threads 66 which has a different thread pitch than the remaining threads 68. In this configuration all the interference is contained within the engaged flanks 56 of small set of threads 66. Although formed somewhat differently than the rings of FIGS. 6 and 7, the operating principle is the same. When the two members are assembled, an assembly torque is reached which will remain essentially constant over a variable engagement distance. With this design it is possible to have the benefits of differentially pitch threads in a single threaded ring bearing design even though the total amount of thread engagement for different implementations may vary.

Figure 9:
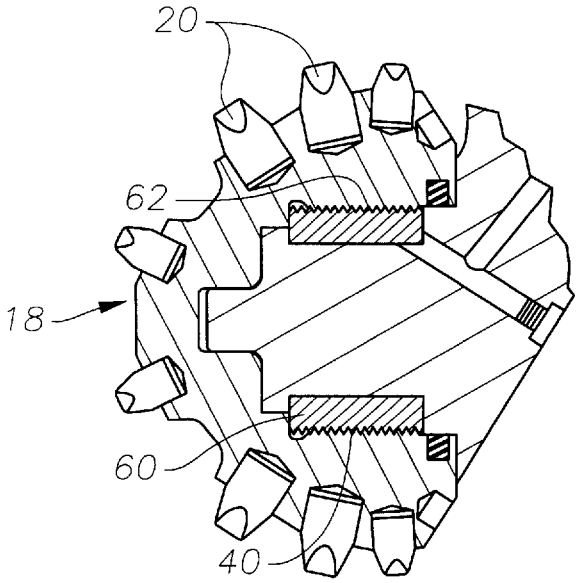
FIG. 9 is an cross sectional view of the threads of the present invention used as a combination thrust and radial bearing.

A configuration for a threaded ring bearing 60 which provides both thrust and radial bearing functions is shown in FIG. 9. In this case the threads 62 of the threaded ring bearing 60 engage the cutter threads 40 over a longer engaged length. The difference in thread pitch for this bearing 60 would typically be much less than the pitch difference for the threaded ring bearings 42 shown in FIGS. 6, 7 and 8.

It would be obvious for one skilled in the art to modify what has been disclosed herein without departing from the spirit and scope of the present invention. For instance, although the threaded rings are shown as having two segments, the rings may be constructed with more than two segments. Although the threads shown in the figures are typical straight machine screw threads, many other thread forms may be used, such as Acme type threads or tapered threads, without departing from the scope of the present invention.

Whereas the present invention has been described in particular relation to the drawings attached hereto, it should be understood that other and further modifications apart from those shown or suggested herein, may be made within the scope and spirit of the present invention.

What is claimed is:

1. A rolling cutter drill bit comprising:

a bit body, at least one bearing spindle on said bit body, a rolling cutter rotatably mounted on said bearing spindle, a first set of screw threads formed in one of said cutter or said bearing spindle, a portion of said first set of screw threads having a first thread pitch, a bearing mounted between said cutter and said bearing spindle, said bearing comprising a split threaded ring having a second set of screw threads, a portion of said second set of screw threads having a second thread pitch, said split threaded ring is in screw threaded engagement with one of said cutter or said bearing spindle, wherein said first thread pitch is different from said second thread pitch.

2. The rolling cutter drill bit of claim 1 wherein said split threaded ring is coaxially mounted between said cutter and said bearing spindle.

3. The rolling cutter drill bit of claim 1 wherein said split threaded ring is adapted to carry thrust loads from said rolling cutter to said bearing spindle.

4. The rolling cutter drill bit of claim 1 wherein said split threaded ring is adapted to carry radial loads from said rolling cutter to said bearing spindle.

5. The rolling cutter drill bit of claim 1 wherein said split threaded ring is adapted to carry both thrust loads and radial loads from said rolling cutter to said bearing spindle.

6. The rolling cutter drill bit of claim 1 wherein a portion of said first screw threads are mechanically deformed by an implement after assembly to further improve resistance to back off of said split threaded ring.

7. A rolling cutter drill bit comprising:

a bit body, at least one bearing spindle on said bit body, a rolling cutter rotatably mounted on said bearing spindle, a first set of screw threads formed in one of said cutter or said bearing spindle, a portion of said first set of screw threads having a first thread pitch, a bearing mounted between said cutter and said bearing spindle, said bearing comprising a split threaded ring having a second set of screw threads, a portion of said second set of screw threads having a second thread pitch, said split threaded ring is in screw threaded engagement with one of said cutter or said bearing spindle, wherein said first thread pitch is different by at least about 0.05% from said second thread pitch.

8. The rolling cutter drill bit of claim 7 wherein said first thread pitch is different by between about 0.05% and about 5% from said second thread pitch.

9. The rolling cutter drill bit of claim 7 wherein said split threaded ring is coaxially mounted between said cutter and said bearing spindle.

10. The rolling cutter drill bit of claim 7 wherein a portion of said first screw threads are mechanically deformed by an implement after assembly to further improve resistance to back off of said split threaded ring.

11. A rolling cutter drill bit comprising:

a bit body, at least one bearing spindle on said bit body, a rolling cutter rotatably mounted on said bearing spindle, a first set of screw threads formed in one of said cutter or said bearing spindle, a portion of said first set of screw threads having a first thread pitch, a bearing mounted between said cutter and said bearing spindle, said bearing comprising a split threaded ring having a second set of screw threads, a portion of said second set of screw threads having a second thread pitch, said split threaded ring is in screw threaded engagement with one of said cutter or said bearing spindle, wherein said first thread pitch is different by at least about 0.1 threads per inch from said second thread pitch.

12. The rolling cutter drill bit of claim 11 wherein said first thread pitch is different by between about 0.1 threads per inch and about 2 threads per inch from said second thread pitch.

13. The rolling cutter drill bit of claim 11 wherein said split threaded ring is coaxially mounted between said cutter and said bearing spindle.

14. The rolling cutter drill bit of claim 11 wherein a portion of said first screw threads are mechanically deformed by an implement after assembly to further improve resistance to back off of said split threaded ring.

* * * * *